US006378154B1

(12) United States Patent
Corrado et al.

(10) Patent No.: US 6,378,154 B1
(45) Date of Patent: Apr. 30, 2002

(54) WEB CLEANING SYSTEM

(75) Inventors: Frank C. Corrado; James W. Fischer, both of Rochester; Gary R. Larsen, Webster; Ron W. Sweet, Conesus, all of NY (US)

(73) Assignee: SeraTek, LLC, Livonia Center, NY (US)

( * ) Notice: Subject to any disclaimer, the term of this patent is extended or adjusted under 35 U.S.C. 154(b) by 0 days.

(21) Appl. No.: 09/501,500

(22) Filed: Feb. 9, 2000

Related U.S. Application Data

(63) Continuation-in-part of application No. 09/442,937, filed on Nov. 18, 1999.

(51) Int. Cl.[7] ..... B08B 1/02
(52) U.S. Cl. ..... 15/3; 15/102
(58) Field of Search ..... 15/3, 100, 102

(56) References Cited

U.S. PATENT DOCUMENTS

| | | | | | |
|---|---|---|---|---|---|
| 3,475,782 | A | * | 11/1969 | Teuber | 15/100 X |
| 4,009,047 | A | | 2/1977 | Lindsay | 134/9 |
| 4,982,469 | A | * | 1/1991 | Nishiwaki | 15/3 |
| 5,251,348 | A | | 10/1993 | Corrado et al. | 15/256.53 |
| 5,423,104 | A | * | 6/1995 | West | 15/100 |
| 5,425,813 | A | * | 6/1995 | Ernst et al. | 15/3 X |
| 5,611,281 | A | | 3/1997 | Corrado et al. | 101/425 |
| 5,699,738 | A | | 12/1997 | Corrado et al. | 101/425 |
| 5,855,037 | A | | 1/1999 | Wieloch et al. | 15/256.5 |
| 5,930,857 | A | * | 8/1999 | Ramos et al. | 15/3 |

* cited by examiner

*Primary Examiner*—Mark Spisich
(74) *Attorney, Agent, or Firm*—Robert C. Brown

(57) ABSTRACT

A system for cleaning particles from a moving web by engagement with contact cleaning rollers, wherein the web may be moved selectively out of contact with the cleaning rollers to prevent damage to the web surface, such as adherance, stripping, or ferrotyping, resulting from stationary contact with the cleaning rollers. The system includes contact cleaning roller assembly disposed adjacent to and transverse of the web path. Preferably, such assembly includes a rotatable turret supporting a plurality of rotatable contact cleaning rollers, preferably three rollers positioned equilaterally. The turret is positioned relative to the basic web path such that, in a non-operative mode, the web is not in contact with the cleaning rollers, the web path bypassing the cleaning rollers. Thus, during periods of maintenance or other downtime, the web first surface is protected from being damaged by stationary contact with the cleaning rollers. The system further comprises at least one, preferably two, movable backing roller adjacent the second surface of the web, the web passing between the backing rollers and the cleaning rollers. To engage the web with the cleaning assembly into an operative mode, the backing rollers are moved towards the turret to alter the basic web path such that the web first surface is brought into engagement with the cleaning rollers in a second web path.

9 Claims, 5 Drawing Sheets

WEB CLEANING SYSTEM

The present application is a Continuation-In-Part of a pending application, Ser. No. 09/442,937, filed Nov. 18, 1999 by Corrado et al.

DESCRIPTION

The present invention relates to apparatus for cleaning particulate contamination from the surfaces of web substrates; more particularly to cleaning apparatus having one or more particle-attracting ("contact cleaning") rollers for transferring particulate contamination from a web surface to the surfaces of the rollers; and most particularly, to such apparatus wherein contact between the contact cleaning rollers and the web may be interrupted as desired, and especially when the web is stationary.

It is well known to convey a web substrate around a particle-attracting roller to cause particulate contaminants on the surface of the web substrate to be transferred to the surface of the roller, thereby cleaning the web substrate. Such rollers are known in the art as "contact cleaning rollers" (CCR's), and may be provided with a tacky surface comprising, for example, adhesive tape as disclosed in U.S. Pat. No. 4,009,047, or an electrostatically-active polymeric surface, for example, a polyurethane as disclosed in U.S. Pat. Nos. 5,611,281 and 5,699,738.

The surface of a contact cleaning roller becomes progressively covered with particles during use, reducing its effectiveness; therefore, the roller surface requires cleaning or "renewal" from time to time. Typically, renewal involves the use of liquid agents such as water or solvents to release the particles from the roller surface. Renewal typically leaves the surface of the roller wet for a short time. Experience has shown that if wet renewal is attempted while a CCR is in working (rolling) contact with a substrate, the cleaning fluid can be tracked undesirably onto the substrate. Therefore, various multiple-roller schemes have been proposed to permit engaging a renewed CCR with a web and disengaging a particle-loaded CCR for off-line cleaning while maintaining continuous cleaning of the web substrate. See, for example, the above-cited U.S. Patents, and also U.S. Pat. No. 5,251,348 ('348), the relevant disclosure of which is hereby incorporated by reference.

Patent '348 discloses an axially rotatable turret disposed transversely of the conveyance path of a web substrate, the turret supporting three equidistantly-spaced contact cleaning rollers adjacent one surface of the web to be cleaned (see FIG. 1 herein). In the rest position of the turret, two rollers are in rolling contact with the moving web, and the third roller is in a cleaning position for renewal. When the third roller has been cleaned and dried, it may be re-engaged with the web as desired by rotating the turret 120° to a new rest position, which also brings one of the other two rollers out of contact with the web and into position for cleaning. Thus, renewed rollers may be continually placed back into service as needed without breaking continuity of cleaning contact of the web with one or more contact cleaning rollers.

The '348 apparatus has been found to present a serious shortcoming when used to clean some delicate web substrates, especially substrates having one or more fragile coatings on the surface being cleaned. When conveyance of the web is stopped and the web is allowed to remain in stationary contact with the contact cleaning rollers for a period of time, the web surface can become adhered to the rollers such that when conveyance is resumed the surface may be stripped from the substrate and remain attached to the rollers, thereby ruining the web for its intended purpose. Even if the substrate surface is not stripped, the adherence can cause a severe web tension imbalance upon an attempt to restart conveyance, resulting in a failure to establish balanced tensions and causing a spontaneous shutdown.

U.S. Pat. No. 5,855,037 discloses a scheme for preventing such adherence and stripping by periodically rotating the turret by a few degrees either clockwise or counterclockwise to bring new portions of the cleaning rollers and web into contact and to break contact between previously-contacting portions thereof before adherence can occur. Such periodic turret rotation can be operationally awkward, and in the extreme, web substrates which adhere very quickly or readily may not be cleaned using this apparatus, which cannot disengage all CCR's simultaneously from the web under any circumstances. This apparatus can be dangerous to operators, especially if the rotation must be conducted every few seconds. Cleaning or change-out of any of the rollers, or examination or maintenance of the rollers or turret during a conveyance shutdown may be physically impossible or may be precluded by OSHA regulations. Electrical repairs can be difficult or dangerous, or simply impossible, because the turret assembly cannot be shut down electrically and locked out to prevent any spontaneous motion, as is standard practice for such electrical work in known web conveyance systems.

It is a principal object of the invention to provide improved web cleaning apparatus which can a) provide contact with at least one contact cleaning roller during normal operation; b) provide easy cleaning or change-out of every contact cleaning roller in the apparatus; c) provide continuous contact, if desired, with at least one cleaning roller during all periods of web conveyance; and d) disengage all contact cleaning rollers from the web whenever desired, whether the web is being conveyed or is stationary.

It is a further object of the invention to provide improved web cleaning apparatus wherein the apparatus can be stopped mechanically and turned off electrically when fully disengaged from the web substrate.

Briefly described, a system for cleaning particles from a first surface of a web being conveyed along a path includes contact cleaning roller means disposed adjacent to and transverse of the web path. Preferably, such means includes a rotatable turret having first and second end plates and a plurality of rotatable contact cleaning rollers, preferably three rollers positioned equilaterally, disposed between the end plates. The basic web path is positioned with respect to the turret such that, in a non-operative mode, the web is not in contact with any of the cleaning rollers, the web path bypassing the turret. Thus, during periods of maintenance or other downtime, the web first surface is prevented from ferrotyping or other damage which may result from stationary contact with the cleaning rollers. The system further comprises at least one movable backing roller adjacent the second surface of the web, opposite the first surface. Preferably, there are two such backing rollers disposed substantially symmetrically about an axial plane through the turret. To engage the web with the cleaning means into an operative mode, the backing rollers are moved towards the turret to alter the web path such that the web first surface is brought into engagement with the cleaning rollers.

The foregoing and other objects, features, and advantages of the invention, as well as presently preferred embodiments thereof, will become more apparent from d reading of the following description in connection with the accompanying drawings in which.

Figure 4:
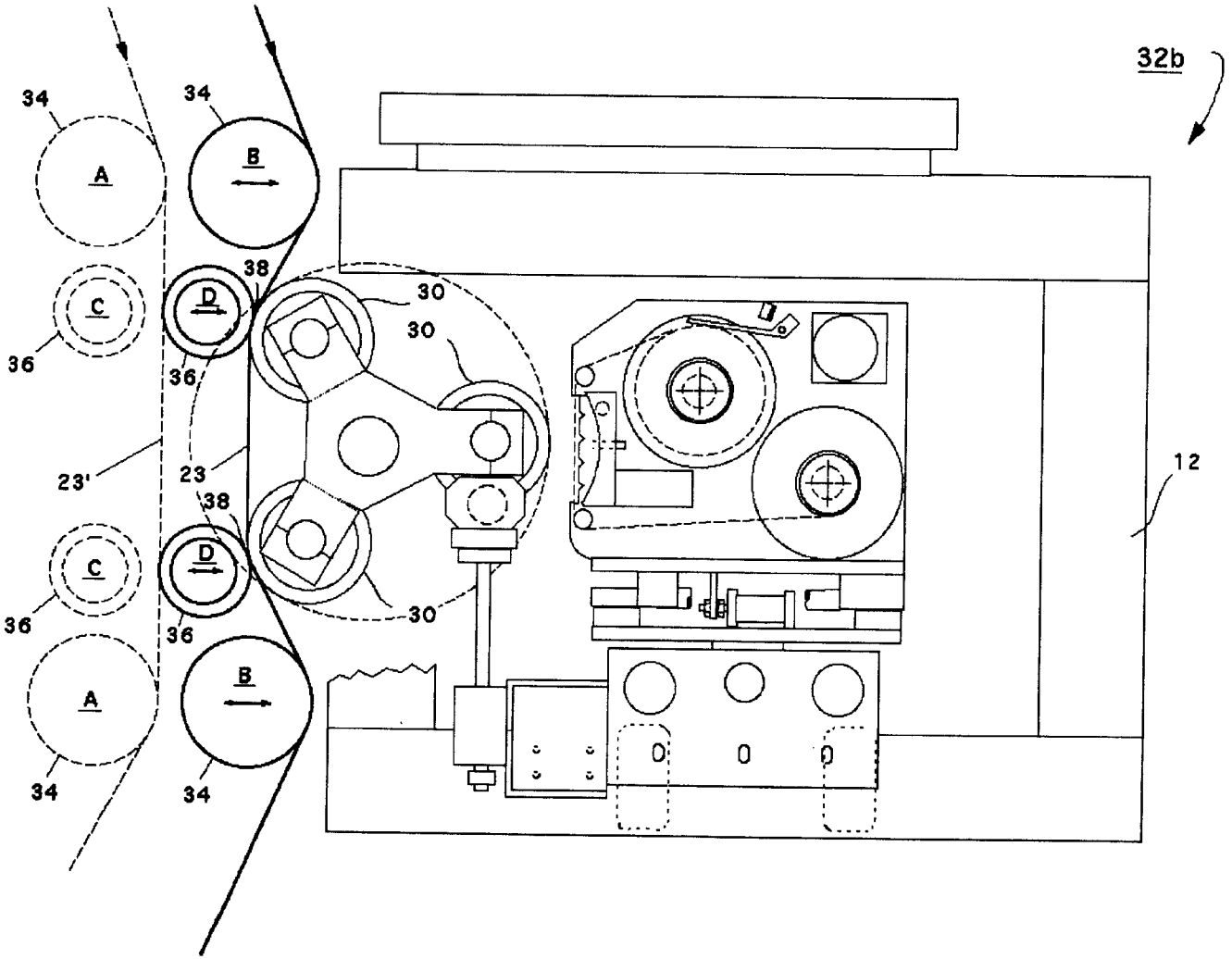
Figure 5:
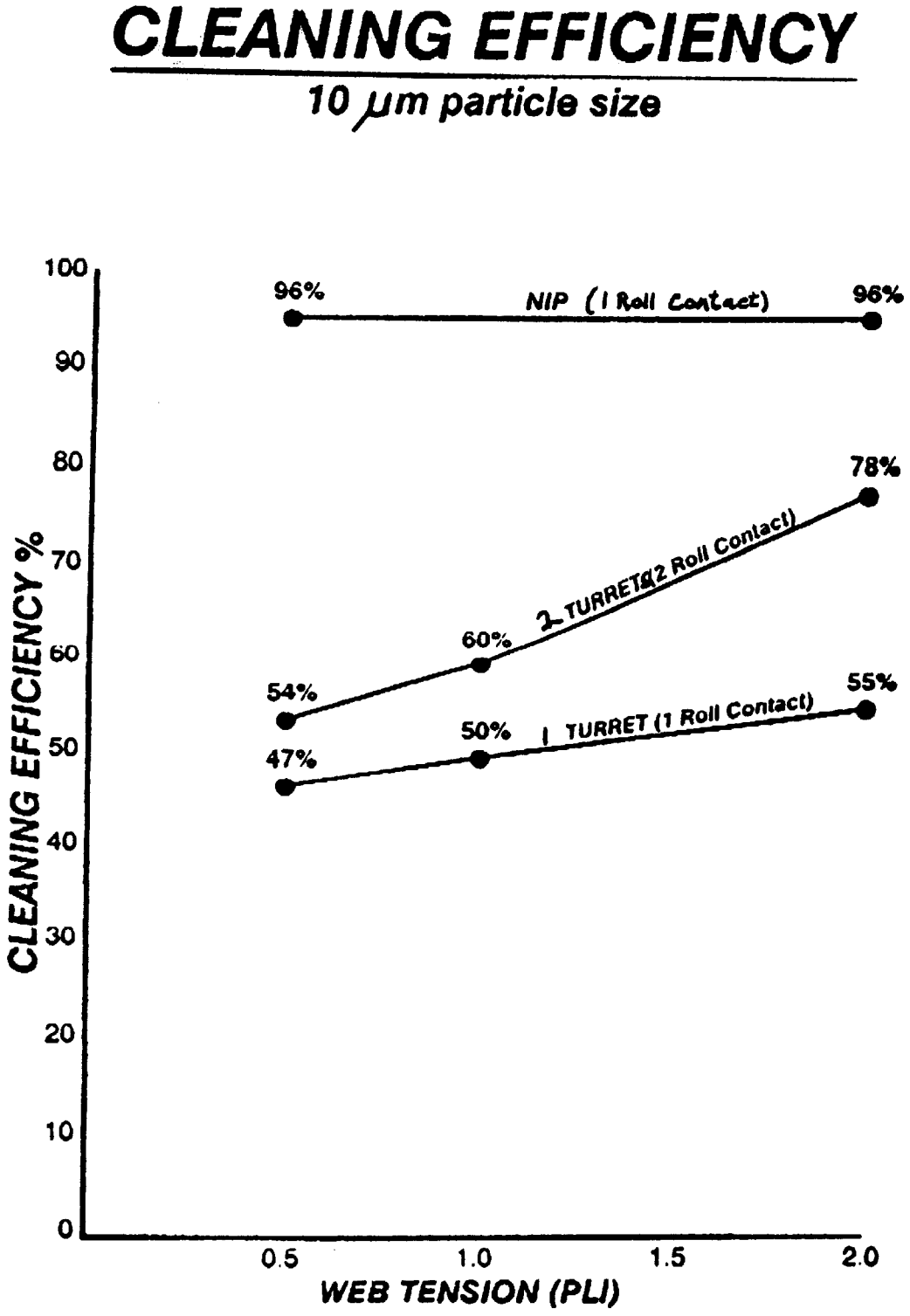

FIG. 4 is a third embodiment of a turreted contact cleaning roller apparatus in accordance with the invention; and FIG. 5 is a graph showing the particle-removal effectiveness of systems having one contact cleaning roller in contact with the web (one turret), two contact cleaning rollers in contact with the web (two turrets), and a contact cleaning roller in nipped relationship with a backing roller.

Figure 1:
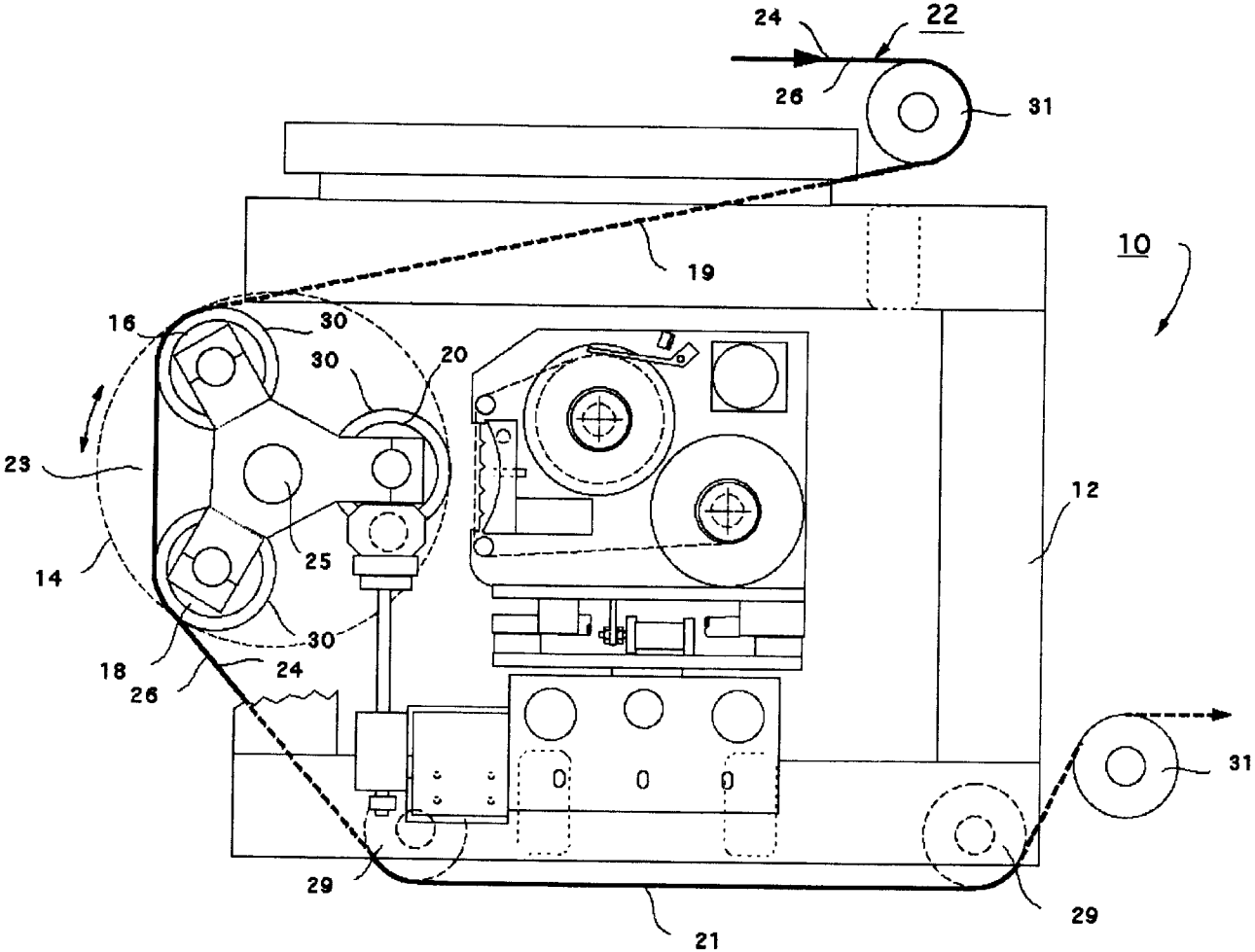
FIG. 1 (PRIOR ART)
FIG. 1 is an elevational cross-sectional view of a prior art turreted contact cleaning roller apparatus, showing the web path passing around the contact cleaning rollers in the turret.

Referring to FIG. 1, a prior art contact cleaning roller apparatus 10 includes a frame 12 supporting a turret 14 containing three equilaterally-spaced contact cleaning rollers 16,18,20, such as are available from, for example, Polymag Tek Inc., Rochester, N.Y. USA. Turret 14 and rollers 16,18,20 are disposed transversely of a web 22 having first and second surfaces 24,26, web 22 being conveyable through apparatus 10 along a web path comprising entry path 19, exit path 21, and cleaning path 23. Turret 14 is programmably rotatable about axis 25 to bring the surfaces 30 of rollers 16,18,20 variably into cleaning contact with surface 24 of web 22. The path 23 of web 22 extends around the periphery of turret 14 so that at any given time, at least two of rollers 16,18,20 are in contact with surface 24. As disclosed in U.S. Pat. No. 5,855,037, while the web is stationary, as during a shutdown or maintenance, turret 14 may be rotated about axis 25 sequentially between the clockwise and counterclockwise directions to cause the rollers to roll a short distance along the stationary web to bring a fresh area of cleaner rolls into contact with the web and to separate from the web those areas of the cleaner rolls that were previously in contact with the web. This action is intended to prevent delamination of coatings on the web upon restarting of the web conveyance system.

Figure 2:
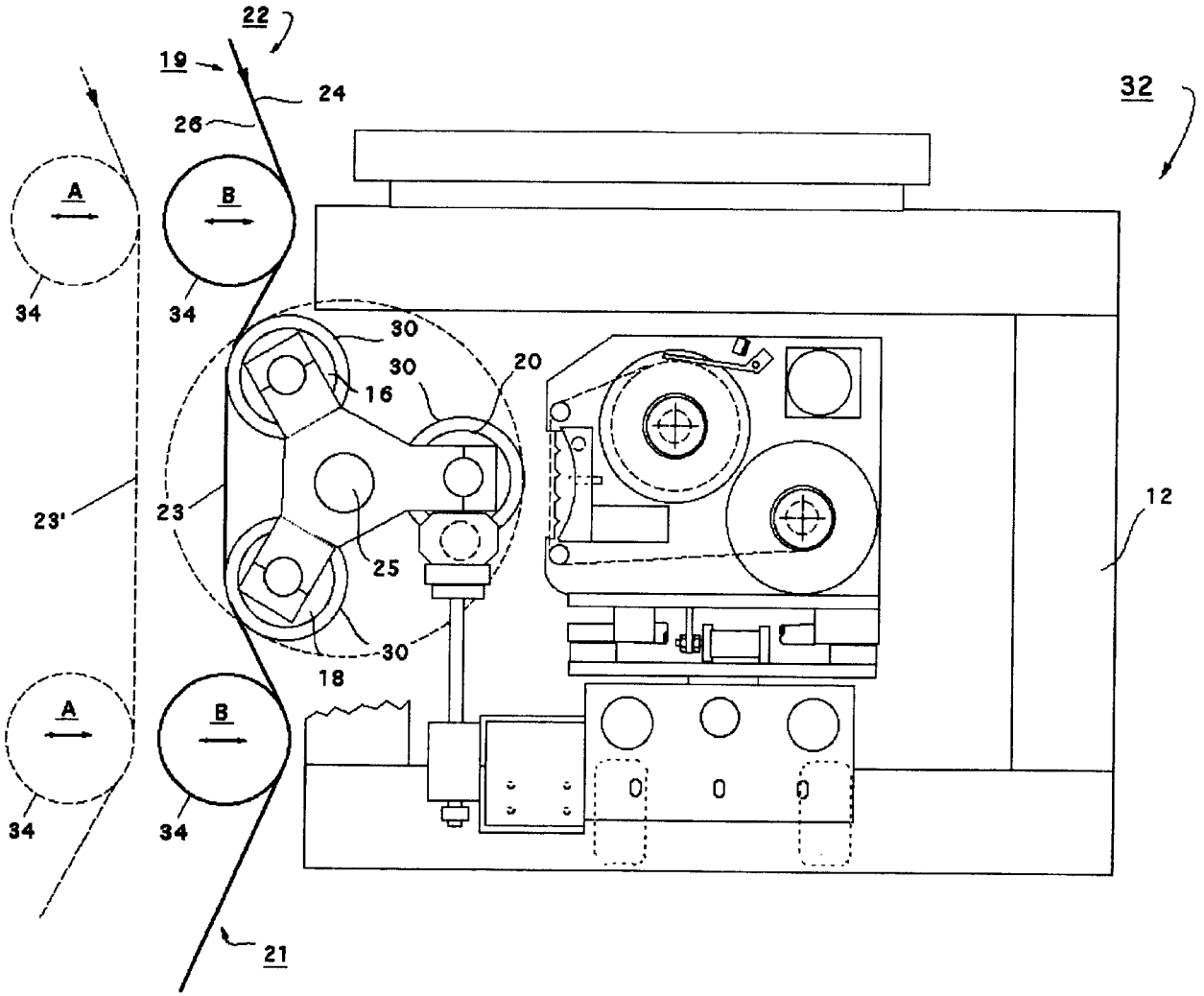
FIG. 2 is a first embodiment of a turreted contact cleaning roller apparatus in accordance with the invention.
Figure 3:
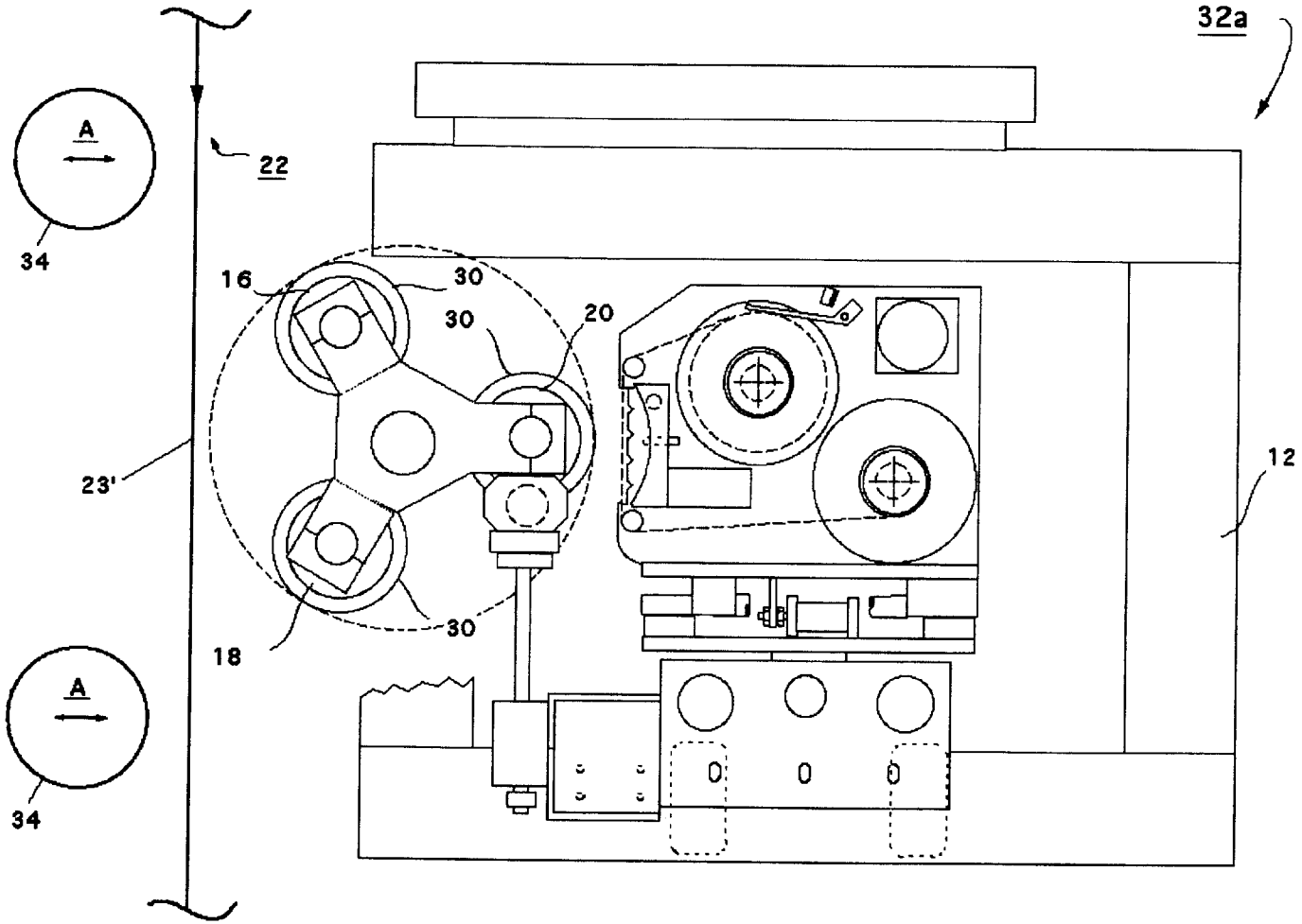
FIG. 3 is a second embodiment of a turreted contact cleaning roller apparatus in accordance with the invention.

Referring to FIG. 2, a first embodiment 32 of a turreted contact cleaning roller apparatus in accordance with the invention may be substantially identical in general layout and cleaning function with prior art apparatus 10. The novelty of the present invention lies in a change in the basic web path, as shown in FIGS. 2–4, and the manipulation of that changed web path. The prior art cleaning system shown in FIG. 1 may be readily retrofitted to provide an improved cleaning system in accordance with the invention.

As shown in FIG. 1, web path 19,21 passes around face-side idle rollers 29 and back-side idle rollers 31 and is thus led through apparatus 10 such that contact of the web with at least one of rollers 16,18,20 is unavoidable at all times. As discussed above, continuous contact of contact cleaning rollers with delicate coatings or other surface treatments on first surface 22 can adversely affect such coatings or treatments.

As shown in FIGS. 2–4, the basic web path with respect to the cleaning apparatus is changed from that shown in FIG. 1. A new basic web path 23' is provided by relocation of rollers 29,31 in known fashion (not shown) such that web 22 passes adjacent to turret 14 but does not make contact with any of contact cleaning rollers 16,18,20, thus providing the desired non-contact relationship not achievable by prior art apparatus 10. Apparatus 32 is further provided with at least one, and preferably two, primary backing rollers 34 disposed adjacent turret 14, web 22 passing between the backing rollers and the cleaning rollers. Primary backing rollers 34 are movably mounted by any one of several well-known mechanisms, for example, on swing arms or slides (not shown), so as to be disposed, alternately, in position A (shown in phantom) when cleaning contact of web surface 24 is not desired, and in position B when such contact is desired. Roller position B establishes the desired web cleaning path 23 through the turret, providing thereby the cleaning effectiveness of prior art apparatus 10. Movement of rollers 34 between positions A and B may cause a lengthening or shortening of the overall web path. Changes in path length may be readily accommodated by any of various well-known take-up devices (not shown). The movement of rollers between positions A and B may be readily controlled by mechanical linkages, motors, and programmable logic controllers (not shown) in known fashion.

In non-contact mode, web 22 may be led, with equal effect, either freely along web path 23' between rollers 34 and turret 14 without contact with rollers 34, as shown in embodiment 32*a* in FIG. 3, or with support from rollers 34, as shown in FIGS. 2 and 4. In installations such as 32*a*, it is preferable that rollers 34 be moved into position B when the web is stationary and not being conveyed, to avoid abrasive damage to the web surface. If rollers 34 are to be engaged with the web when the web is being conveyed, rollers 34 preferably are provided with means for matching the linear surface speed of the roller to the linear conveyance speed of the web prior to engagement of rollers 34 with the web, to prevent potential scuffing of the web. Suitable speed matching means is well known.

It is known that the cleaning effectiveness of a contact cleaning roller may be enhanced by providing a pressure-roller nip at the cleaning point to urge the web into intimate contact with the surface of the cleaning roller. We have found that nip roller cleaning can be substantially more effective than free-span cleaning in removing particles from a web substrate. In nip roller cleaning, the moving web passes through a pressure nip between a contact cleaning roller on the side of the web being cleaned and a backing roller on the other side of the web, unlike free-span cleaning in which the web has no backing support urging it toward the cleaning roller. The cleaning modes discussed herein previously are all free-span.

In the present invention, as shown in embodiment 32*b* in FIG. 4, one or more secondary movable backing rollers 36, alternable between positions C (shown in phantom) and D in similar fashion to the alternability of rollers 34 between positions A and B, may be provided to form nips 38 against contact cleaning rollers 16,18,20. Preferably, in position C (shown in phantom) secondary rollers 36 are fully disengaged from the web.

The improvement in cleaning provided by a nip roller is shown in FIG. 5. In tests of removing particles 10 $\mu$m in diameter from a web surface at various web tensions, expressed in pounds of tension per linear inch of web width, a single free-span cleaning roller 16 removed between 47% and 55% of the particles; two successive free-span rollers, 16,18 as in embodiment 32, removed between 54% and 78% of the particles; and a single nipped cleaning roller, 16 plus 36, removed 96% of the particles at all web tensions tested. In embodiment 32*b*, both cleaning rollers 16,18 are nipped by backing rollers 36.

From the foregoing description, it will be apparent that there has been provided an improved system for cleaning particles from web substrates, wherein the web may be readily disengaged from the cleaning apparatus as desired.

Variations and modifications of the herein described system, in accordance with the invention, will undoubtedly suggest themselves to those skilled in this art. Accordingly, the foregoing description should be taken as illustrative and not in a limiting sense.

What is claimed is:

1. In a system for cleaning particles from the surface of a web substrate including contact cleaning roller means contactable with a web substrate surface, the web substrate being conveyable along a web path, the improvement comprising:

a) a first path for said web substrate wherein said web is non-contacting of said contact cleaning roller means;

b) a second path for said web substrate wherein said substrate surface is in cleaning contact with said contact cleaning roller means; and c) means for moving said web substrate from said first web path to said second web path and for returning said web substrate from said second web path to said first web path.

2. A system in accordance with claim 1 wherein said contact cleaning roller means comprises at least one contact cleaning roller.

3. A system in accordance with claim 1 wherein said contact cleaning roller means comprises:

a) a rotatable turret; and b) a plurality of contact cleaning rollers rotatably disposed within said turret.

4. A system in accordance with claim 1 wherein said means for moving comprises at least one primary movable backing roller.

5. A system in accordance with claim 4 wherein said means for moving comprises a plurality of primary movable backing rollers.

6. A system in accordance with claim 4 wherein said backing roller is non-contacting of said web when said web is in said first web path.

7. A system in accordance with claim 4 wherein said backing roller is in contact with said web when said web is in said first web path.

8. A system in accordance with claim 1 further comprising secondary movable roller means for urging said web against said contact cleaning means in a nipped relationship when said web is in said second web path.

9. A system in accordance with claim 8 wherein said secondary movable roller means comprises a plurality of rollers.

* * * * *